US005697172A

United States Patent [19]

Verseef

[11] Patent Number: 5,697,172

[45] Date of Patent: Dec. 16, 1997

[54] TRIP EDGE SNOWPLOW

[75] Inventor: Jan Verseef, Fort Myers, Fla.

[73] Assignee: Schmidt Engineering & Equipment, Inc., New Berlin, Wis.

[21] Appl. No.: 490,471

[22] Filed: Jun. 14, 1995

[51] Int. Cl.[6] ..... E01H 5/04

[52] U.S. Cl. ..... 37/232; 37/233; 172/264

[58] Field of Search ..... 37/232, 233, 172, 37/264, 265, 266, 267

[56] References Cited

U.S. PATENT DOCUMENTS

| | | | |
|---|---|---|---|
| 2,775,830 | 1/1957 | Kenyon | 37/232 |
| 2,999,697 | 9/1961 | Winget . | |
| 3,008,251 | 11/1961 | Cline et al. . | |
| 3,456,369 | 7/1969 | Leposky | 37/232 |
| 3,587,751 | 6/1971 | Schmidt, Jr. | 37/232 X |
| 3,712,383 | 1/1973 | Renahan | 172/264 |
| 4,208,974 | 6/1980 | Dreyer et al. | 172/264 |
| 4,255,878 | 3/1981 | Mähler et al. | 37/232 |
| 4,259,794 | 4/1981 | Rath | 37/232 X |
| 4,293,043 | 10/1981 | Neukom et al. | 172/267 |
| 4,307,523 | 12/1981 | Reissinger et al. | 37/232 X |
| 4,794,710 | 1/1989 | Häring | 37/232 |
| 5,079,866 | 1/1992 | Farrell | 37/233 X |
| 5,191,729 | 3/1993 | Verseef | 37/232 |
| 5,323,862 | 6/1994 | Furlough | 172/264 X |

FOREIGN PATENT DOCUMENTS

| | | | |
|---|---|---|---|
| 168893 | 1/1951 | Austria | 37/232 |
| 215468 | 7/1961 | Austria | 37/232 |
| 223646 | 10/1962 | Austria | 37/232 |
| 840124 | 4/1970 | Canada | 172/264 |
| 1901794 | 8/1970 | Germany | 37/232 |
| 2437723 | 3/1975 | Germany | 37/232 |
| 2519112 | 11/1976 | Germany | 37/232 |
| 2617235 | 10/1977 | Germany | 37/232 |
| 103836 | 4/1964 | Norway | 37/232 |
| 313333 | 5/1956 | Switzerland | 37/232 |
| 348420 | 10/1960 | Switzerland | 37/232 |

*Primary Examiner*—Terry Lee Melius
*Assistant Examiner*—Thomas A. Beach
*Attorney, Agent, or Firm*—Reinhart, Boerner, Van Deuren, Norris & Rieselbach, s.c.

[57] ABSTRACT

A snowplow mountable on a track or similar vehicle includes a displaceable trip edge that enables the plow to pass over trip hazards without transferring significant impact forces to the plow. The plow mold board includes one or more trip plates that are coupled to the mold board through compression spring elements and linkages. The linkages cause the trip edge to swing up and away from the pavement to avoid "undercutting" when a trip hazard is encountered. This helps keep the plow from jumping. The linkage also automatically reduces the moment arm defined by the compression spring element, the trip plate and the mold board so as substantially to compensate for an increasing restoring force generated by the compression spring member as it is progressively compressed. The trip plate can thereby be displaced over its entire range without significantly increasing the contact force between the trip plate and an encountered trip hazard. The forces transmitted to the plow and the vehicle on which it is mounted are minimized thereby reducing wear and minimizing the perceived jolt when a hip hazard is encountered.

9 Claims, 4 Drawing Sheets

TRIP EDGE SNOWPLOW

BACKGROUND OF THE INVENTION

This invention relates generally to snowplows and, more particularly, to trip edge or soft edge snowplows.

Snow is commonly removed from streets and highways by means of snowplows mounted at the front end of trucks and similar vehicles. Such plow-equipped vehicles commonly move at 30 to 40 mph or more while plowing. Because streets are not perfectly smooth and sometime contain raised manhole-lips, cracks and other such unexpected obstructions, a constant danger exists that the plows' lower scraping edge will unexpectedly encounter such an obstacle or "trip hazard." The potentially catastrophic consequences of such an encounter are easy to imagine. Accordingly, efforts have been made to avoid or minimize damage and danger when a moving plow encounters a trip hazard.

Typically, the adverse consequences of unexpected encounters with trip hazards are minimized by means of a "trip edge" or "soft edge" located at the lowermost edge of the plow mould board. The trip edge is designed to yield when an obstacle is encountered thereby permitting the plow to pass over the obstacle without harm. In one arrangement, a lip is pivotally attached to the lower edge of the mold board and is held in place by springs. When an obstacle is encountered, the lip pivots back against the springs. As the springs compress, greater and greater force is required to deflect the lip. Furthermore, as the lip pivots, its lowermost edge tends to describe a circular arc that, if actually followed, would extend below or "undercut" the level of the pavement surface. Because the lip cannot, of course, actually pass through the pavement, the entire plow instead jumps up (sometimes by as much as three or four feet) as the lip swings through the bottom of its arc. Although catastrophic damage is avoided, a noticeable and startling jolt is still transferred to the vehicle when the plow passes over the trip hazard. Wear and tear results in both the plow mechanism and vehicle, and the sudden and unexpected jolt can distract the driver, possibly causing a loss of vehicle control.

SUMMARY OF THE INVENTION

The invention provides a trip edge snowplow comprising a mould board having a lower edge, a trip plate having a scraping edge and structure for mounting the trip plate adjacent the lower edge of the mould board for movement between displaced and undisplaced positions. The trip plate is mounted so that the scraping edge defines a path that swings upwardly toward the mould board as the trip plate moves from the undisplaced position to the displaced position. As the trip plate is displaced, the scraping edge passes no farther from the lower edge of the mould board than when the trip plate is in the undisplaced position.

The invention also provides a trip edge snowplow comprising a mould board having a lower edge, a trip plate and a linkage mounting the trip plate on the mould board adjacent the lower edge. The linkage includes an elongate spring lever having a first end pivotally engaging the mould board and a second end pivotally engaging the trip plate and further includes a stop lever having one end pivotally engaging the mould board and another end pivotally engaging the hip plate so that the trip plate can swing up and away from the lower edge of the mould board.

The invention also provides a trip edge snowplow comprising a mould board having a lower edge and a trip plate mountable adjacent the lower edge in cooperating association with the mould board. The trip edge snowplow further includes an elongate spring lever having a first end pivotally engaging the mould board and a second end pivotally engaging the trip plate. The trip edge snowplow further includes a stop lever having one end pivotally engaging the mould board and another end pivotally engaging the trip plate so that the trip plate can swing up and away from the lower edge of the mould board. An elongate compression member or spring having one end pivotally coupled to the mould board and another end pivotally coupled to the spring lever between the first and second ends is also provided. The spring provides a progressively increasing restoring force with progressively increasing displacement of one end of the spring toward the other end. The spring and the spring lever are oriented relative to each other and to the mould board so that the moment arm between the spring and the mould board progressively decreases with progressively increasing displacement of one end of the spring toward the other. This substantially compensates for the progressively increasing restoring force of the spring and thereby biases the trip plate relative to the mould board with a substantially constant bias force.

It is an object of the present invention to provide a new and improved trip edge snowplow.

It is a further object of the present invention to provide a new and improved trip edge snowplow that reduces the force transferred to the plow as the plow passes over a trip hazard.

It is a further object of the present invention to provide a new and improved trip edge snowplow that avoids undercutting the pavement and that minimizes the generation of upward forces as the plow passes over a trip hazard.

It is a further object of the present invention to provide a trip edge snowplow having a trip edge that deflects under a substantially uniform deflection force so that force transfer from the trip edge to the mould board is minimized as the plow passes over a trip hazard.

BRIEF DESCRIPTION OF THE DRAWINGS

The features of the present invention that are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figure 2:
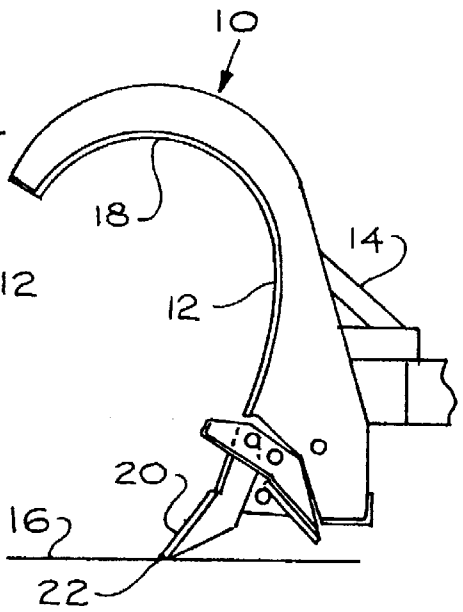
FIG. 2 is a side elevation view of the trip edge snowplow shown in FIG. 1 showing trip plates in both deflected and undeflected positions.
Figure 1:
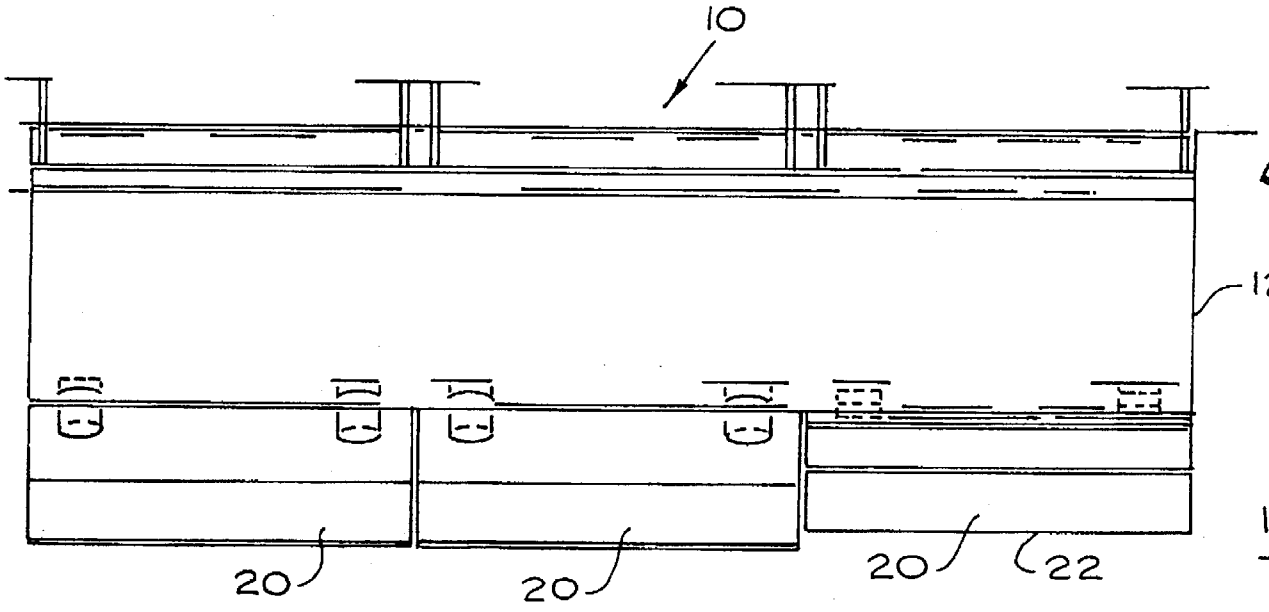
FIG. 1 is a front elevation view of a trip edge snowplow embodying various features of the invention.

Referring to the drawings, and, in particular, to FIGS. 1 and 2, a trip edge snowplow 10 embodying various features of the invention is illustrated. The snowplow 10 includes an elongate mould board 12 having a drive frame 14 permitting attachment to the front end of a truck or similar vehicle (not shown). The mould board 12 includes a lower trip edge configured to contact pavement 16 that is to be plowed and further includes a curved upper end 18 for containing and redirecting the snow that is plowed. In use, the vehicle pushes the mould board 12 along the pavement 16 thereby scraping up the fallen snow and directing the accumulated snow off to the side.

The snowplow 10 includes one or more trip plates 20 mounted adjacent the lower edge of the mould board 12 for movement between undeflected and deflected positions. As shown in FIG. 2, when a trip plate 20 is in an undeflected position, its lowermost edge or scraping edge 22 is in contact with the pavement 16 to collect the fallen snow. When the trip plate 20 is in the deflected position, it swings up and away from the lower edge of the mould board 12 to provide vertical clearance between the lower edge 22 of the mould board 12 and the pavement 16. This permits the plow 10 to pass over obstructions or trip hazards such as projecting manholes without causing serious damage to the plow or potential danger to the operator. In the illustrated embodiment, the mould board 12 is equipped with three independently moveable trip plates 20.

In accordance with one aspect of the invention, each trip plate 20 is mounted to the lower edge of the mould board 12 so as to swing up and away from the pavement 16 when an obstacle or trip hazard 24 (FIG. 3) is encountered. In particular, each trip plate 20 is mounted so as to avoid undercutting the pavement 16 (i.e., trying to drive the scraping edge 22 of the trip plate 20 below the level of the pavement surface) as the trip plate 20 moves to the deflected position. To this end, each trip plate 20 is mounted to the mould board 12 so that, as the trip plate 20 moves to the displaced position, the scraping edge 22 moves upwardly toward the mould board 12 and passes no farther from the lower edge of the mould board 12 than when the trip plate 20 is in the undisplaced position.

Figure 3:
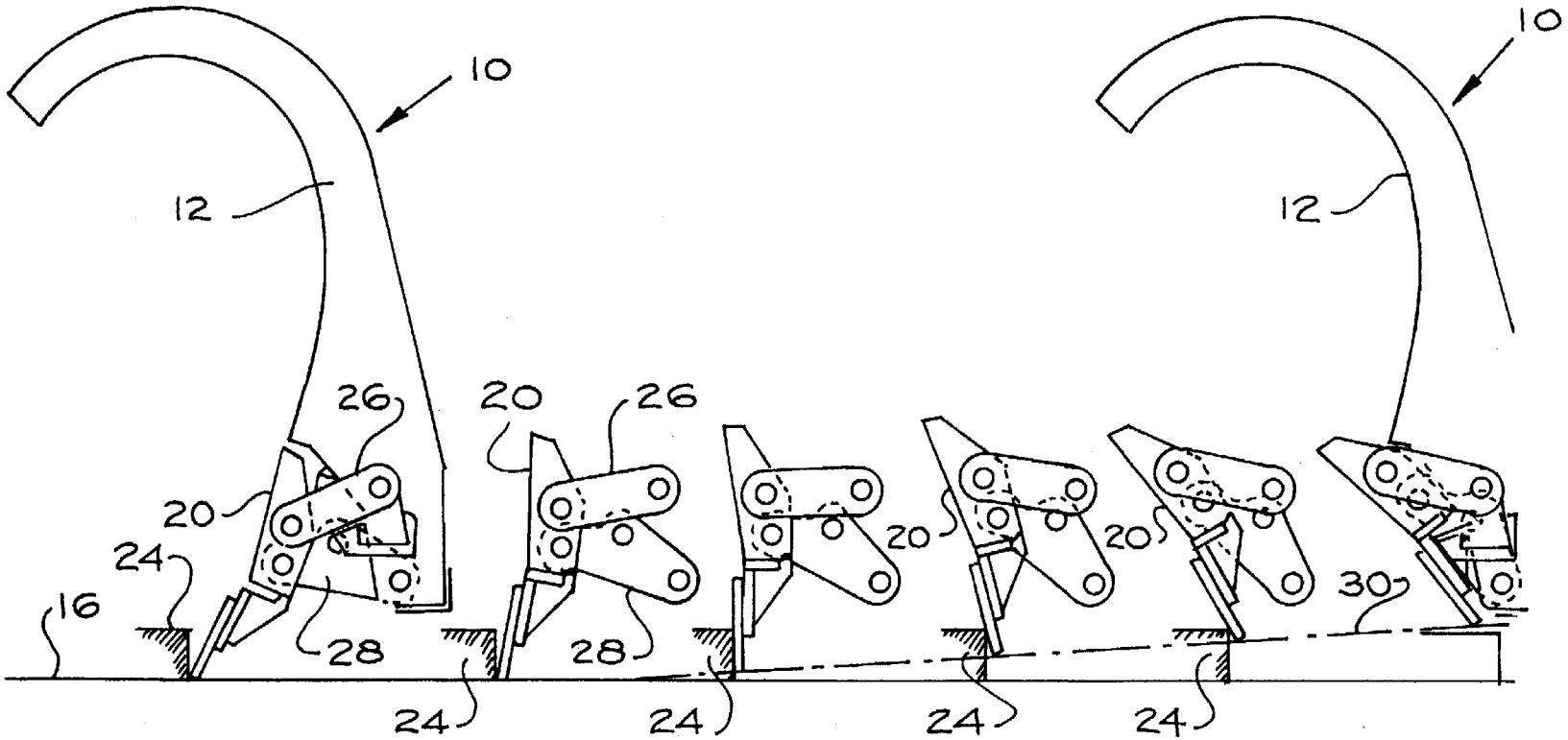
FIG. 3 is a side elevation view showing the operation of the trip edge snowplow and the movement of the trip edge as the snowplow passes over a hip hazard.

As illustrated in FIG. 3, each trip plate 20 is mounted to the mould board 12 by means of linkages 26 and 28 that cause the lower edge 22 of the trip plate 20 to move along a path 30 shown by the broken line when an obstacle or trip hazard 24 is encountered. Assuming that the plow 10 is moving to the left as shown in FIG. 3 when the trip plate 20 first encounters the trip hazard 24, the lower edge 22 of the trip plate 20 moves horizontally backwardly relative to the mould board 12 with substantially no downward vertical movement. As the plow 10 continues its movement and the trip plate 20 is displaced still further, the lower edge 22 of the trip plate 20 begins to rise relative to the pavement 16 until sufficient clearance has been obtained to enable the trip plate 20 to pass over the trip hazard 24. Significantly, and in contrast to prior designs wherein a simple pivot or hinge arrangement was used to connect a trip plate to a mould board, the lower edge 22 of the trip plate 20 is not forced downwardly against the pavement 16 as the trip plate 20 is initially displaced but, rather, swings up and away from the pavement 16. The trip plate 20 herein shown and described thus enables the plow 10 to pass over a trip hazard 24 without transmitting significant upwardly directed forces to the plow 10 or the vehicle on which it is mounted.

Except when an obstacle or trip hazard 24 is encountered, the trip plates 20 are preferably maintained in the undeflected position. To this end, biasing means are provided for biasing each trip plate 20 toward the undeflected position. Preferably, the trip plates 20 are biased toward the undeflected position with a substantially uniform restoring force so that the trip plates 20 can pass over encountered obstacles 24 without transferring forces to the mould board 12 that are substantially greater than the restoring force holding the trip plates 20 in the undeflected position. In other words, when a trip hazard 24 is encountered and the contact force between the trip hazard 24 and trip plate 20 exceeds the restoring force, the trip plate 20 will swing from the undeflected position to the deflected position without substantially increasing the contact force between the trip plate 20 and the trip hazard 24. This has the effect of minimizing the forces transferred to the mould board 12, resulting in less wear and tear on the equipment and greater comfort for the operator.

Referring to FIGS. 4–7, the restoring force for biasing each trip plate 20 to the undeflected position is provided by means of an elongate compression member or spring 32. In the illustrated embodiment, the spring 32 preferably comprises a hollow rubber spring of the type manufactured by Timbren as Type No. 740. The spring 32 is mounted between a lower plate assembly 34 and an upper plate 36 and provides a progressively increasing restoring force as the spring 32 is compressed between its two ends. The lower plate assembly 34 includes a center core 38 around which the spring 32 is mounted and further includes a lower end 40 adapted for coupling to the linkage 28. Although a hollow rubber spring is illustrated, it will be appreciated that other forms of compression members, such as helically wound metallic compression springs, air pressure, hydraulic pressure or torsion bars can also be used.

Preferably, the compression member or spring 32 is coupled to the trip plate 20 so as to compensate for the non-uniformity of the restoring force developed by the spring 32. By so compensating, the trip plate 20 is biased toward the undeflected position with a restoring force that remains substantially uniform despite the fact that the compression member or spring 32 develops a progressively stronger restoring force the more it is compressed.

Figure 5:
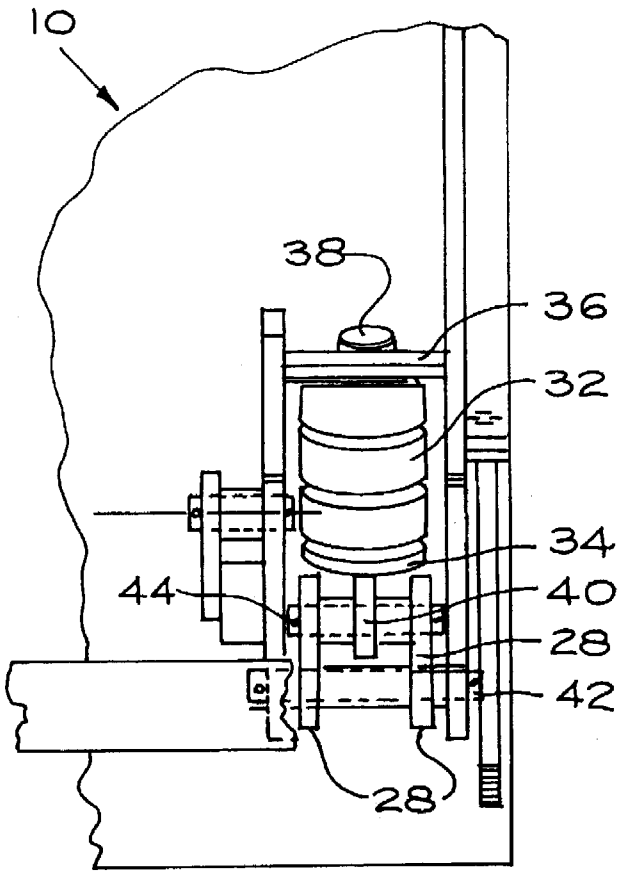
FIG. 5 is a fragmentary, rear elevation view of a linkage assembly embodying various features of the invention, showing the linkage in a lowered or uncompressed position.
Figure 4:
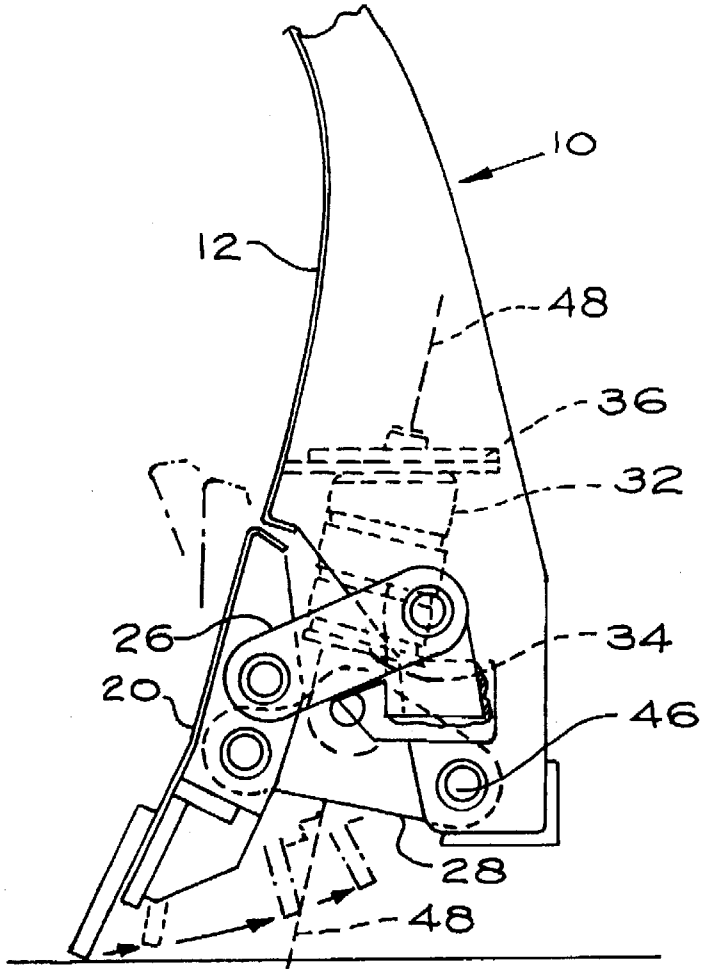
FIG. 4 is fragmentary side view, partially in section, showing the hip edge in a undeflected position.

Both the displacement path 30 (FIG. 3) of each trip plate 20 and the force required to deflect each trip plate 20 are functions of the linkages 26 and 28 that mount each trip plate 20 to the mould board 12 and couple each trip plate 20 to a spring 32. The displacement path 30 is created because of the combination of linkages 26 and 28. In the illustrated embodiment, the linkage 28 has one end pivotally attached to the mould board 12 and another end pivotally attached to the trip plate 20. One end of the spring 32 is pivotally mounted to the mould board 12 by means of the upper plate 36 that limits upward movement of the spring 32 but permits angular movement of the spring 32 relative to the mould board 12. The lower end 40 of the lower plate assembly 34 is pivotally secured to the linkage 28 between the ends thereof. In the illustrated embodiment, the spring 32 applies a generally downwardly directed force onto the linkage 28 between the ends thereof. The other linkage 26 has one end pivotally attached to the mould board 12 and another end pivotally attached to the trip plate 20. When so secured, the trip plate 20 can swing up and away from the pavement 16 as illustrated in FIGS. 3 and 4. The combined operation of the linkages 26 and 28 cause the lower edge 22 of the trip plate 20 to follow the path 30 shown in FIGS. 3 and 4 rather than a path that would force the trip plate 20 down into harder contact with the pavement 16. As illustrated in FIG. 5, a pair of the linkages 28 are associated with each spring 32 and are interconnected by means of pivot pins 42 extending through suitably formed apertures opening therethrough. The linkage 26 pilots around a pivot pin 44.

When the trip plate 20 is in the undeflected position shown in FIG. 4, the restoring force provided by the spring 32 is applied to the trip plate 20 through a moment arm defined by the spring 32, the linkage 28 and the pivotal attachment point 46 between the spring 32 and the mould board 12. In FIG. 4, the moment arm, which is defined by the perpendicular distance between the center of the pivot point 46 and the projection of the central longitudinal axis 48 of the spring 32, is relatively long. At the same time, because the spring 32 is not substantially compressed, the restoring force it provides is relatively low. The product of the restoring force and the moment arm substantially determines the overall bias force with which the trip plate 20 is held in the undeflected position.

Figure 7:
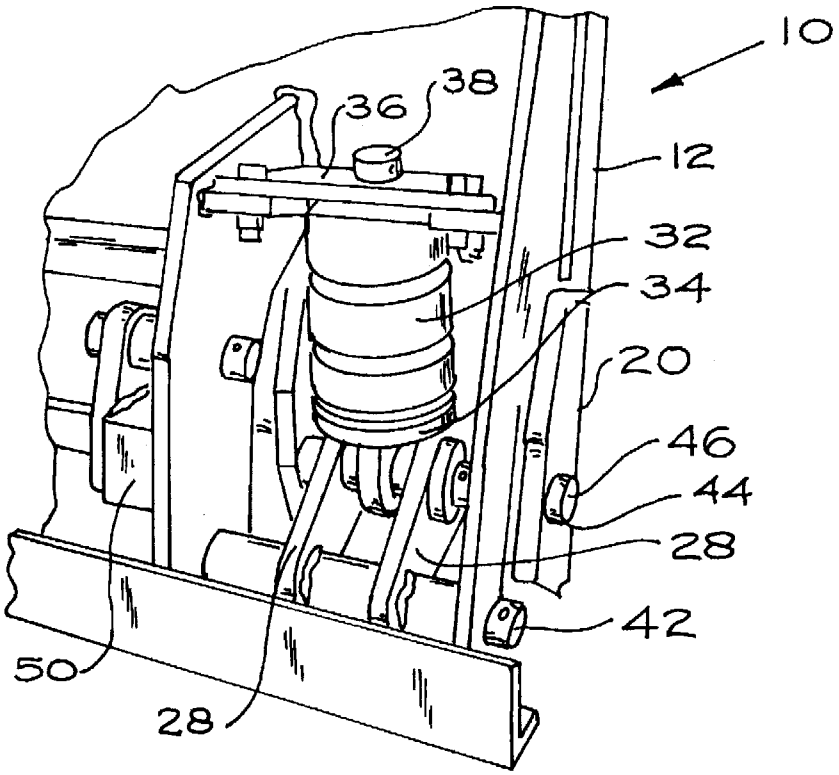
FIG. 7 is fragmentary, rear, perspective view, similar to FIG. 5, showing the linkage assembly in a raised or compressed condition.
Figure 6:
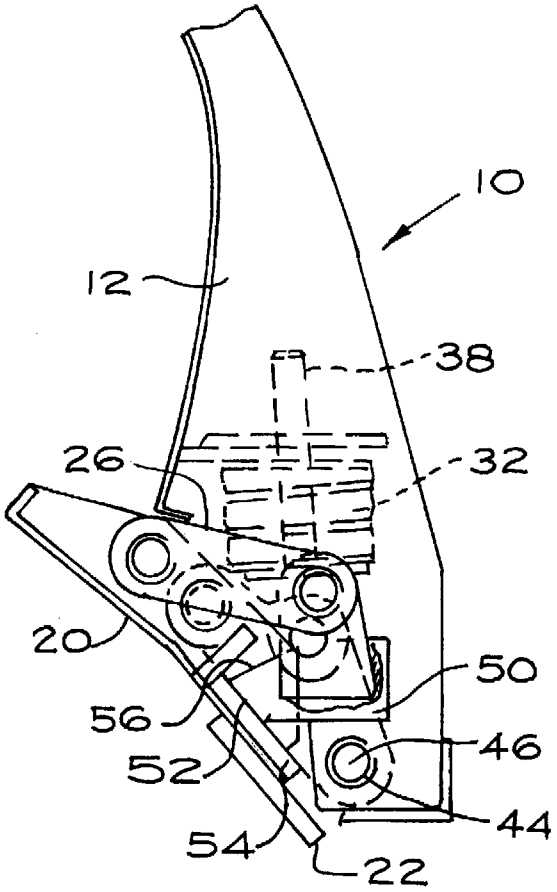
FIG. 6 is fragmentary side view, similar to FIG. 4, showing the hip edge in a raised or deflected position.

When the trip plate 20 encounters a trip hazard 24 and is moved to the deflected position shown in FIGS. 6 and 7, the linkage 28 swings up thereby substantially compressing the spring 32. At the same time, however, the movement of the linkage 28 shifts the angular position of the spring 32 bringing the central longitudinal axis 48 of the spring closer to the pivot point 46 thereby reducing the moment arm defined by the spring 32, the linkage 28 and the pivot point 46. Preferably, the reduction in the moment arm offsets the increase in the restoring force developed by the now substantially compressed spring 32 so that the overall bias force on the trip plate 20 remains substantially unchanged from when the trip plate 20 is in the undeflected position. In this manner, the linkages 26 and 28 permit the trip plate 20 to swing up and out of the way to permit the trip plate 20 to pass over an encountered obstacle or trip hazard 24 without substantially increasing the contact force between the trip hazard 24 and the plow 10. When the plow 10 passes over the trip hazard, 24 the bias force developed by the spring 32 and the linkages 26 and 28 returns the trip plate 20 to the undeflected position.

Preferably, a positive stop is provided to prevent further movement of the trip plate 20 when it reaches the maximum deflected position shown in FIGS. 6 and 7. To this end, one or more stops 50, each having an angled forward edge 52, is preferably mounted behind the trip plate 20 as shown. When the maximum deflected position is reached, the rear surface of the trip plate 20 engages the stop 50 member to prevent further deflection of the trip plate 20. Preferably, a solid backing plate 54 is mounted along the interior rear edge of the trip plate 20 to reinforce the lower edge 22 of the trip plate. The scraping edge 22, which actually engages the pavement 16 during use, is preferably attached to the lowermost outer edge of the trip plate 20. The stop 50 also includes an upper edge 56 that engages the linkage 26 on the downstroke when the trip plate 20 returns to the undeflected position.

The trip edge plow 10 herein shown and described is advantageous in that the plow 10 can pass over immovable obstructions or trip hazards 24 without transferring a substantial shock or jolt to the plow 10. The linkages 26 and 28 that couple the trip plates 20 to the mould board 12 allow the trip plates 20 to swing up and away from the pavement 16 to avoid "undercutting," and thereby avoid transferring upwardly directed forces to the plow and vehicle. In addition, the linkages 26 and 28 overcome the inherent property of compression spring members 32 to provide a progressively larger restoring force with increased deflection. This also contributes to the reduction of impact forces transferred to the plow 10. The trip plate arrangement disclosed herein thus reduces the overall shock or jolt that is transferred by the plow assembly to the driving vehicle when an obstacle or trip hazard 24 is encountered.

It will be appreciated that although specific compression members, lever shapes and linkage geometries are shown, these can be altered in various respects without departing from the invention in its broader aspects.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A trip edge snowplow comprising:

a mould board having a lower edge;

a trip plate having a scraping edge; and a mounting structure for mounting said trip plate adjacent said lower edge of said mould board for movement with respect to said mould board between displaced and undisplaced positions, and a spring element operable to provide a restoring force for biasing said trip plate toward said undisplaced position;

wherein said scraping edge is coupled to self-adjusting links such that said scraping edge is displaced upwardly and extends backwardly with respect to said mould board substantially along an axis offset from vertical as said trip plate moves from said undisplaced position to said displaced position and an upper edge of said trip plate moves to a location in front of said mould board as said trip plate moves to said displaced position; and said scraping edge of said trip plate extends no further downward from said lower edge of said mould board than when said trip plate is in said undisplaced position.

2. A trip edge snowplow as defined in claim 1 wherein said means for mounting includes an elongate spring lever having a first end pivotally engaging said mould board and a second end pivotally engaging said trip plate and further includes a stop lever having one end pivotally engaging said mould board and another end pivotally engaging said trip plate.

3. A trip edge snowplow as defined in claim 2 further comprising a linkage coupling said spring element to said trip plate so as to compensate for non-uniformities in said restoring force so that said trip plate is biased toward said undeflected position with a substantially uniform bias force.

4. A trip edge snowplow comprising:

a mould board having a lower edge;

a trip plate having a scraping edge and an upper edge; and self-adjusting links mounting said trip plate on said mould board adjacent said lower edge;

said self-adjusting links including:

an elongate spring lever having a first end engaging said mould board and a second end engaging said trip plate; and a stop lever having one end engaging said mould board and another end engaging said trip plate so that said trip plate can be displaced upwardly and extend backwardly away from said lower edge of said mould board;

and said scraping edge extends from an undisplaced position ahead of said lower edge to a displaced position behind said lower edge, said scraping edge extending no further downward from said lower edge of said mould board than when said trip plate is in said undisplaced position wherein said upper edge is forward of said mould board in said displaced position.

5. A trip edge snowplow as defined in claim 4 further comprising an elongate compression member having one end pivotally coupled to said mould board and another end pivotally coupled to said spring lever between said first and second ends.

6. A trip edge snowplow as defined in claim 6 wherein said compression member provides progressively increasing restoring force with progressively increasing displacement and wherein said linkage further includes means for compensating for said progressively increasing restoring force so that said trip plate is biased toward said undeflected position with a substantially uniform restoring force.

7. A trip edge snowplow comprising:

a mould board having a lower edge;

a trip plate mountable adjacent said lower edge in cooperating association with said mould board;

an elongate spring lever having a first end pivotally engaging said mould board and a second end pivotally engaging said trip plate;

a stop lever having one end pivotally engaging said mould board and another end pivotally engaging said trip plate so that said trip plate can swing up and away from said lower edge of said mould board; and an elongate compression member having one end pivotally coupled to said mould board and another end pivotally coupled to said spring lever between said first and second ends;

said elongate compression member providing a progressively increasing restoring force with progressively increasing displacement of said one end of said compression member toward said other end of said compression member;

said compression member and said spring lever being oriented relative to each other and to said mould boards so that the moment arm between said compression member and said mould board progressively decreases with progressively increasing displacement of said one end of said compression member toward said other end of said compression member so as substantially to compensate for said progressively increasing restoring force and thereby bias said trip plate relative to said mould board with a substantially constant bias force.

8. A trip edge snowplow comprising:

a mould board having a lower edge;

a trip plate having a scraping edge; and self-adjusting links mounting said plate adjacent said lower edge, for motion with respect to said mould board;

said self-adjusting links including:

an elongate spring lever having a first end engaging said mould board and a second end engaging said trip plate; and a stop lever having one end engaging said mould board and another end engaging said trip plate, and said scraping edge is displaced upwardly and extends backwardly from an undisplaced position ahead of said lower edge, substantially along an axis offset at least thirty degrees from vertical, to a displaced position behind and no further downward from said lower edge while enabling snow plowing to be performed at substantially full capacity by both a portion of said trip plate extending in front of said mould board and said mould board.

9. A trip edge snowplow as defined in claim 8 further including a spring biasing a lower portion of said linkage toward said undisplaced position.

* * * * *